US005335460A

United States Patent [19]

Smith, Jr.

[11] Patent Number: 5,335,460

[45] Date of Patent: Aug. 9, 1994

[54] TILT TO CLEAN GUTTER SYSTEM

[76] Inventor: Joseph H. Smith, Jr., 31 Broadmoor La., Rotunda West, Fla. 33947

[21] Appl. No.: 57,634

[22] Filed: May 7, 1993

Related U.S. Application Data

[63] Continuation-in-part of Ser. No. 874,415, Apr. 27, 1992, abandoned.

[51] Int. Cl.[5] ..... E04D 13/06

[52] U.S. Cl. ..... 52/11; 16/233; 16/387; 16/389; 248/48.2

[58] Field of Search ..... 248/48.1, 48.2; 52/11, 52/12, 15, 16, 95; 16/226, 387, 388, 389, 390, 391, 392, DIG. 29; 134/33

[56] References Cited

U.S. PATENT DOCUMENTS 2,624,067 1/1953 Tassell ..... 16/DIG. 29
4,061,151 12/1977 Ward ..... 52/11
4,117,635 10/1978 Nelson ..... 52/11
4,745,657 5/1988 Faye ..... 16/226

FOREIGN PATENT DOCUMENTS 330852 6/1930 United Kingdom ..... 16/DIG. 29

OTHER PUBLICATIONS

The Woodworkers' Store Catalog: 1990–1991 p. 14.

*Primary Examiner*—Michael Safavi
*Attorney, Agent, or Firm*—Frank A. Lukasik

[57] ABSTRACT

A hinged hanger system for pivotably attaching a rain gutter to the fascia of a building beneath the edge of a roof comprising a plurality of hinged hangers for mounting and supporting the rain gutter in a tiltable position, the hangers consisting of an "L" shaped bracket and a hinge section nestled within horizontal supports and pivotably hinged to the horizontal supports, and a pulley system with lines attached to the rain gutter for tilting the gutter to a dumping position and resetting the gutter to a receiving position.

1 Claim, 8 Drawing Sheets

TILT TO CLEAN GUTTER SYSTEM

RELATED APPLICATIONS

This application is a continuation-in-part of patent application Ser. No. 07/874,415, filed Apr. 27, 1992, now abandoned.

BACKGROUND OF THE INVENTION

1. Field of the Invention

This invention relates generally to an improvement in a drain trough system associated with the eaves of a building, and is more particularly concerned with a system which improves the mounting and cleaning of drain troughs.

2. Discussion of the Prior Art

Most residential type dwellings are constructed with pitch roofs, the sloped nature of which prevents the accumulation of water therein. Beneath the lower extremity of a pitched roof, generally referred to as the eaves, there is positioned a drain trough or gutter, to catch water which runs off the roof, and channel it to a downspout which leads the water away from the foundation of the house.

In the course of time, such drain troughs tend to accumulate debris such as fallen leaves and branches, which obstruct the troughs. Also, during the winter, water tends to accumulate and freeze, thus blocking the troughs, which overflow towards the house, and thereby wetting the fascia which eventually rots and must be replaced.

Although a number of methods have been previously disclosed for simplifying the servicing of eaves mounted drain troughs, none have been completely successful in operation or sufficiently practical to enjoy widespread commercial utilization. One such prior art device is shown in U.S. Pat. No. 4,309,792 to Faye which disclosed a hinged bracket assembly for mounting a drain trough and comprising an upper harness member pivotably joined to a lower support bracket member. The harness member is constructed to enclasp a conventional drain trough in a sliding manner.

Another prior art device is shown in U.S. Pat. No. 4,311,292 to Deason discloses a mechanism for attaching a gutter comprising an "L" shaped bracket having a vertical and a horizontal leg, a hinged member attached to the horizontal leg at an extremity remote from the vertical leg and a releasable fastener adapted to cooperate with a pop rivet disposed on the gutter. U.S. Pat. No. 4,669,232 to Wyatt discloses a gutter support for dumping leaves by application of force by hand held tools at ground level and having spring like holding clips at the outside top edge of a rain gutter and pivoted about a hinge supported lower inside corner.

Although for many years there have been attempts to pivotally support gutters, none of these are believed to be available today. One possible reason for the lack of pivoted gutters is the complexity or ineffectiveness of the means for pivoting the gutters. Applicant has developed an effective, inexpensive, solution to the tilting problem of the prior art devices.

SUMMARY AND OBJECTIVES OF THE INVENTION

Accordingly, an objective of this invention is to provide a cleanable gutter which is relatively inexpensive, reliable, and easy to clean from the ground level.

A further object of the invention is to provide a cleanable gutter which requires few moving parts and can be manipulated from ground level.

A still further object of the invention is to provide "L-shaped" hinge brackets for pivotally fastening a gutter to a fascia and a system for tilting the gutter from the ground for emptying debris.

These objects and other objects and advantages of the invention will be apparent from the following description and claims.

SUMMARY OF THE INVENTION

The above and other beneficial objects and advantages are accomplished in accordance with the present invention by forming metal into "L-shaped" mount and hinge devices which may be used to pivotally mount rain gutters to the fascia of a house and comprises a system for rotating and tilting the gutters while standing on the ground level. The hinged hanger is constructed so as to fully support the gutter in its upright position. The hinged hanger may be made from a single stamping of a flat steel or other metal plate. The system for rotating and tilting the gutter may be a pulley and rope system or an electric motor. The instant invention may be easily installed to convert the standard method of mounting gutters which usually consists of driving a long spike through the top of the gutter and into the fascia board. The spikes are generally located approximately 2 feet apart. The hinged hanger of the instant invention may be spaced as far apart as 7 feet, however, 4 to 5 feet is preferred.

When the gutter requires emptying, a quick, firm pull of the rope will tilt the gutter to an inverted position and the debris will be emptied. With the aid of the rope and pulley system, the operator may stand in a position at the end of the gutter to avoid being hit by the falling debris.

To permit rotation of the gutter, the downspout must be disconnected and a gap left between the gutter outlet and the downspout. To assure collection of water flowing from the gutter outlet to the downspout, a galvanized funnel may be used or the top of the downspout may be flared out to form an enlarged opening.

Rotation of the gutter to the inverted position also exposes the fascia board to permit painting or other maintenance when needed. In addition, during the periods of freezing and thawing, the gutters often accumulate ice and water. As the gutter becomes filled with ice, the melting snow runs over and onto the fascia or under the roofing and thus causing water damage. The instant invention may be used to conveniently empty the ice and water during the period when there is a slight thaw and the ice and water may be poured out by rotation of the gutter. Because of the strength of the hinged hanger of the instant invention and the fact that it may be screwed into the fascia, the gutter will be capable of supporting larger loads of water and ice than the current spike system.

BRIEF DESCRIPTION OF THE DRAWINGS

For a fuller understanding of the nature and objects of the invention, reference should be had to the following detailed description taken in connection with the accompanying drawings forming a part of this specification and in which similar numerals of reference indicate corresponding parts in all the figures of the drawings.

DESCRIPTION OF THE PREFERRED EMBODIMENTS

Figure 1:
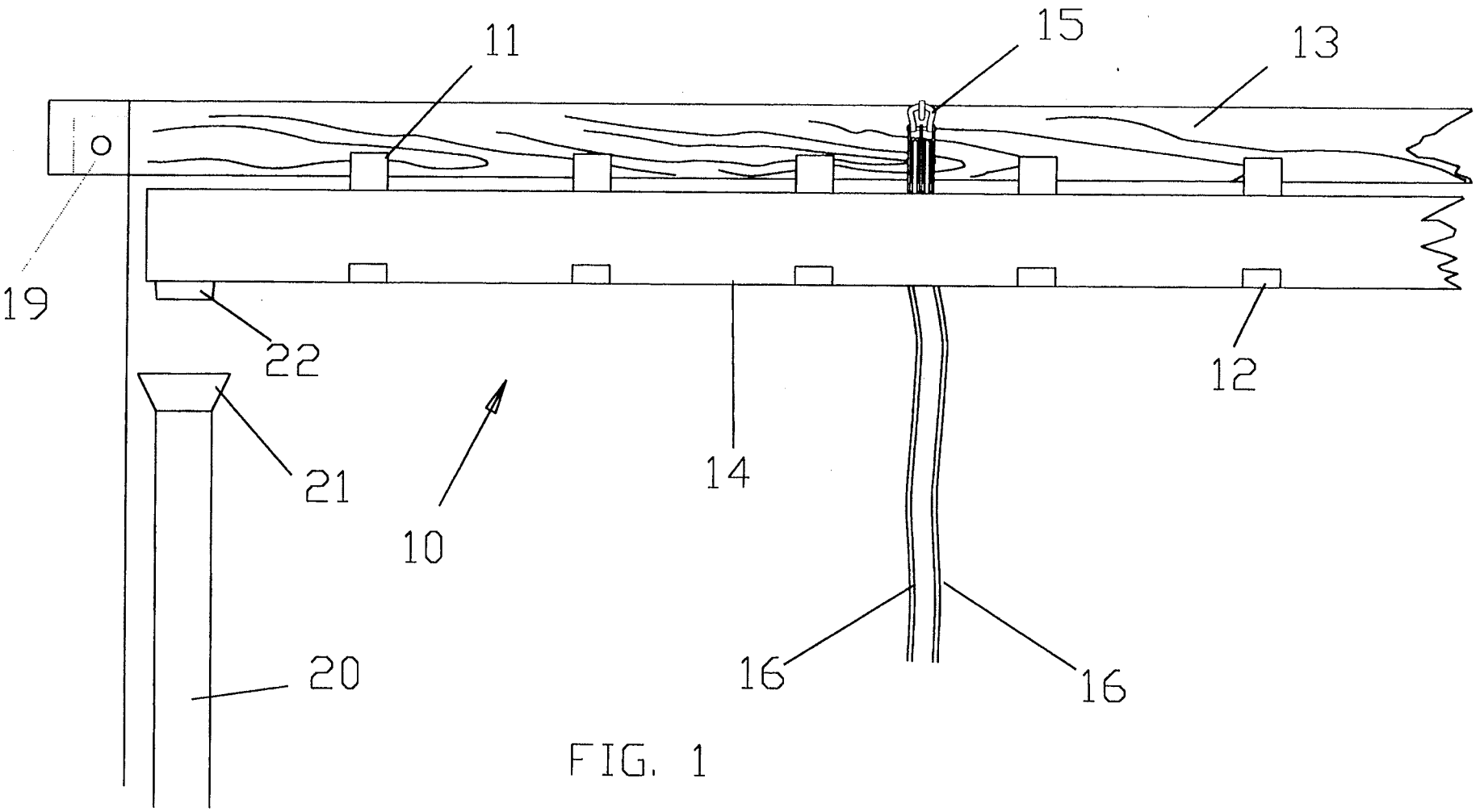
FIG. 1 is a front view, partially in section, of a gutter system according to the invention as it is installed on the fascia of a house roof.
Figure 2:
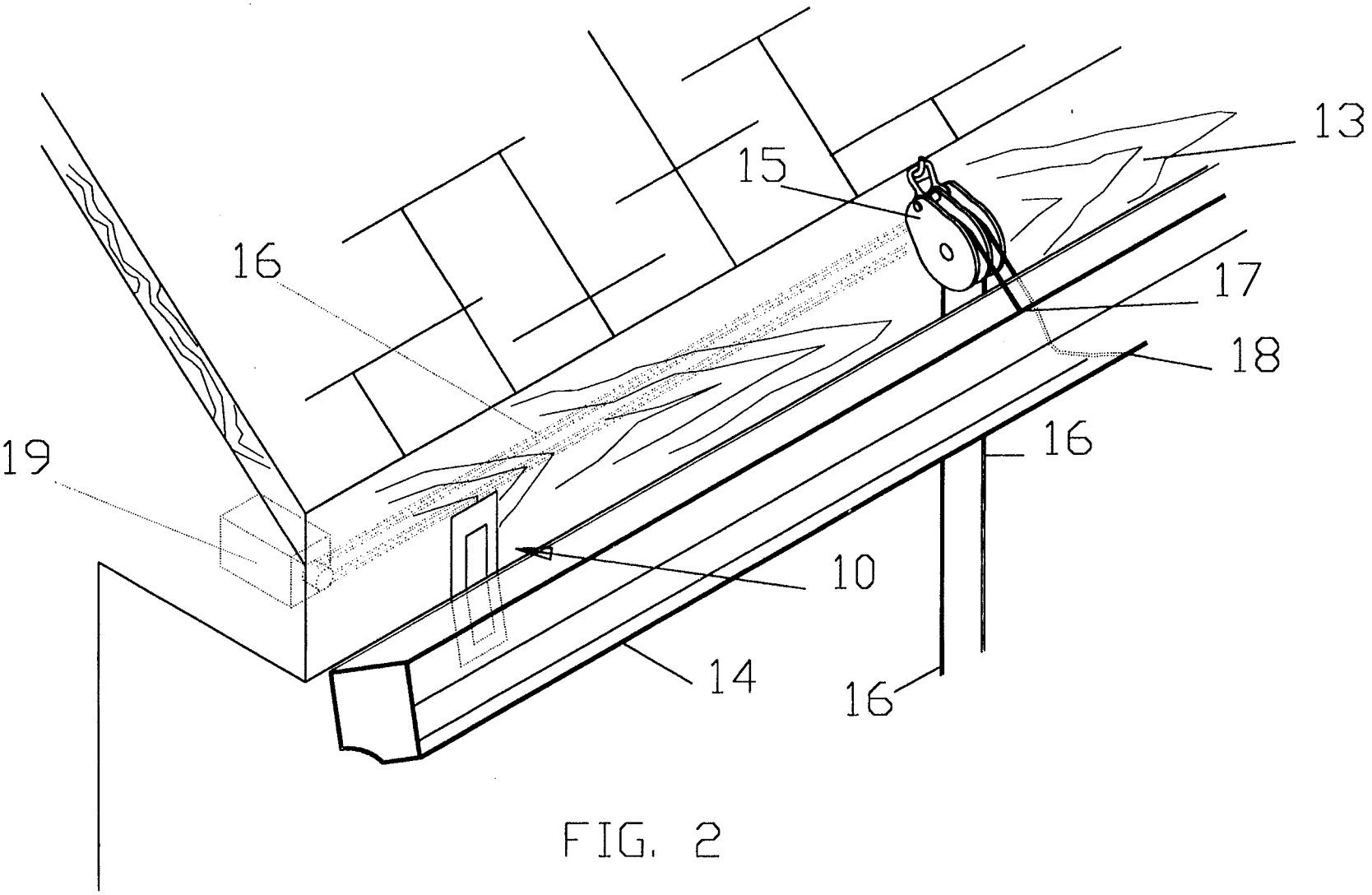
FIG. 2 is a perspective view, partially in section, of a gutter system in accordance with the invention in a partially tilted position.

Referring now to FIGS. 1 and 2, the gutter system of the invention is shown mounted on a building. FIG. 1 is a front view showing the hinged hangers 10 comprising support bracket 11 and hinge section 12. Support bracket 11 is fastened to fascia 13 and hinge section 12 is fastened to the bottom of gutter 14. Also shown is an awning pulley 15 with double sheaves which allow the tilting action to be accomplished from the ground using ¼ inch cotton or other line 16 threaded through the pulley 15. One end of line 16 is fastened to the gutter 14 through a hole 17 in the upper backside of the gutter 14, one half inch from the edge. A second line 16, loops under the gutter 14 and back up to the front top edge to a hole 18 drilled one half inch from the top. The lines 16 are threaded through the holes 17 and 18 and a knot is tied on the inside.

Because of the rotation of the gutter 14, the gutter 14 cannot be attached directly to the downspout 20. To accommodate the tilting action of gutter 14, the downspout 20 is lowered about 10 inches and a funnel 21 will be made to flare out about 6 inches (to be received by the downspout) and will be mounted about 4 inches under the drop outlet 22 coming out of the gutter 14.

Also shown in FIGS. 1 and 2 is an alternative embodiment for tilting the gutter 14. For a mechanized version of the gutter system of the invention, lines 16 and electric motor 19 (shown in dashed lines) may be used to tilt the gutter 14 instead of manually pulling lines 16 to empty the gutter.

Referring now to FIGS. 3–8, hinged hanger 10 is shown in various views. Hinged hanger 10 is comprised of support bracket 11 and hinged section 12. Vertical panel 26 of support bracket 11 is attached to fascia 13 through screw holes 27. Horizontal panel 28 is formed with a hinge section 29. Horizontal panel 28 of hinged section 12 is attached to support bracket 11 with hinge pin 24, bolts or rivets. The gutter 14 is attached to hinged section 12 with screws 25, two screws 25 on the vertical leg and one or two on the bottom of the gutter 14. Rivets or other fasteners may also be used to fasten the hinged section 12 to the butter 14. Gutter 14 is illustrated as a standard 5 inch aluminum rain gutter. The hinged hanger 10 may be made of steel, brass, aluminum, plastic or other suitable material.

Figure 3:
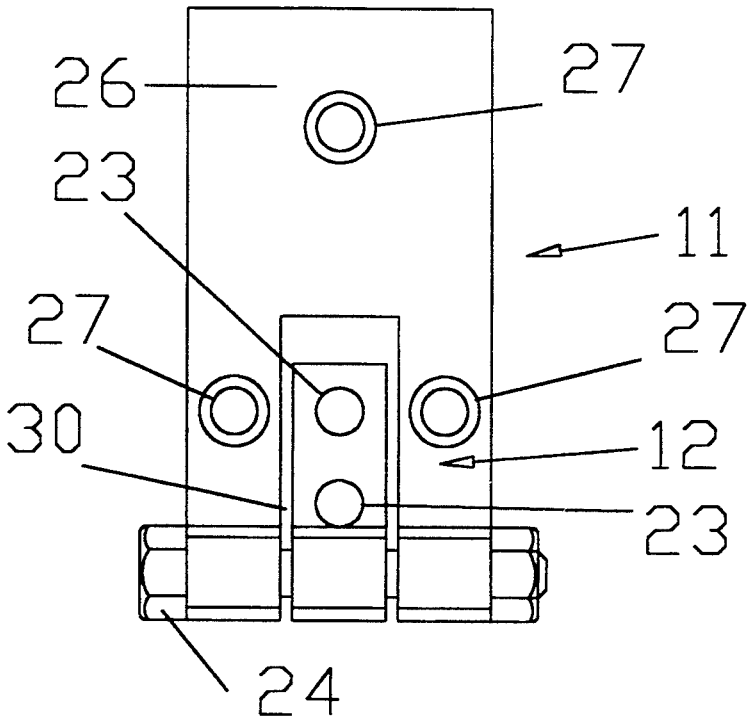
FIG. 3 is a front view of a hinged hanger in accordance with the invention.
Figure 4:
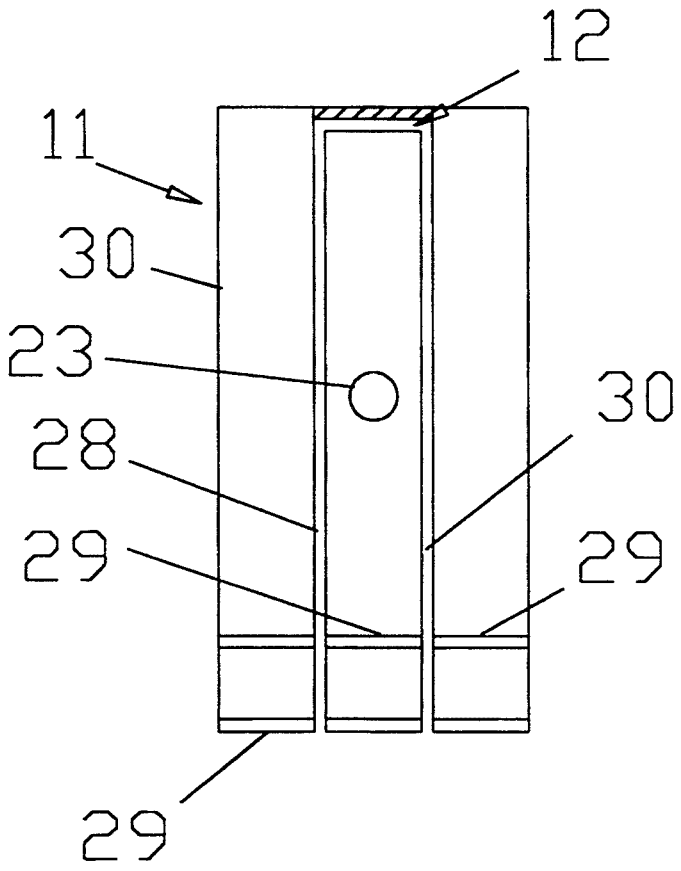
FIG. 4 is a top view of a hinged hangar in accordance with the invention.
Figure 5:
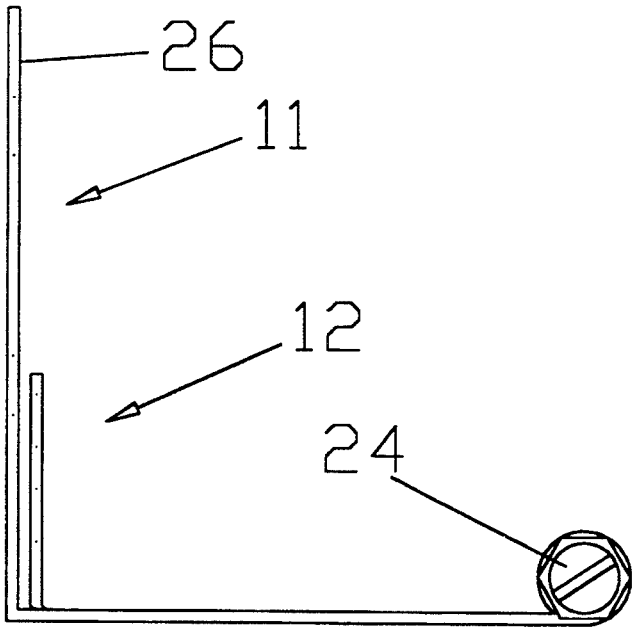
FIG. 5 is a side view of a hinged hanger in accordance with the invention.
Figure 6:
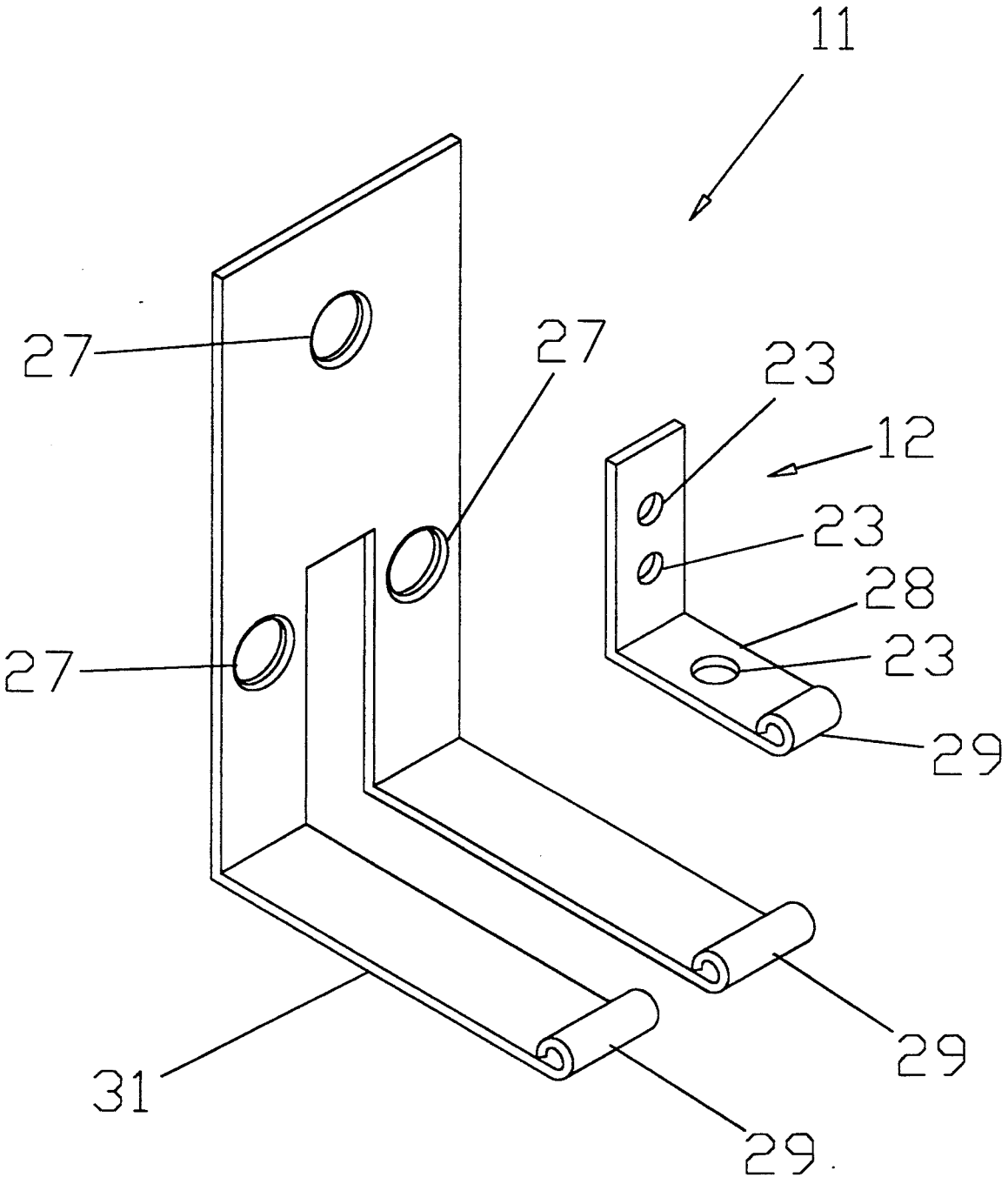
FIG. 6 is a perspective, exploded view of the hinged hanger in accordance with the invention.
Figure 7:
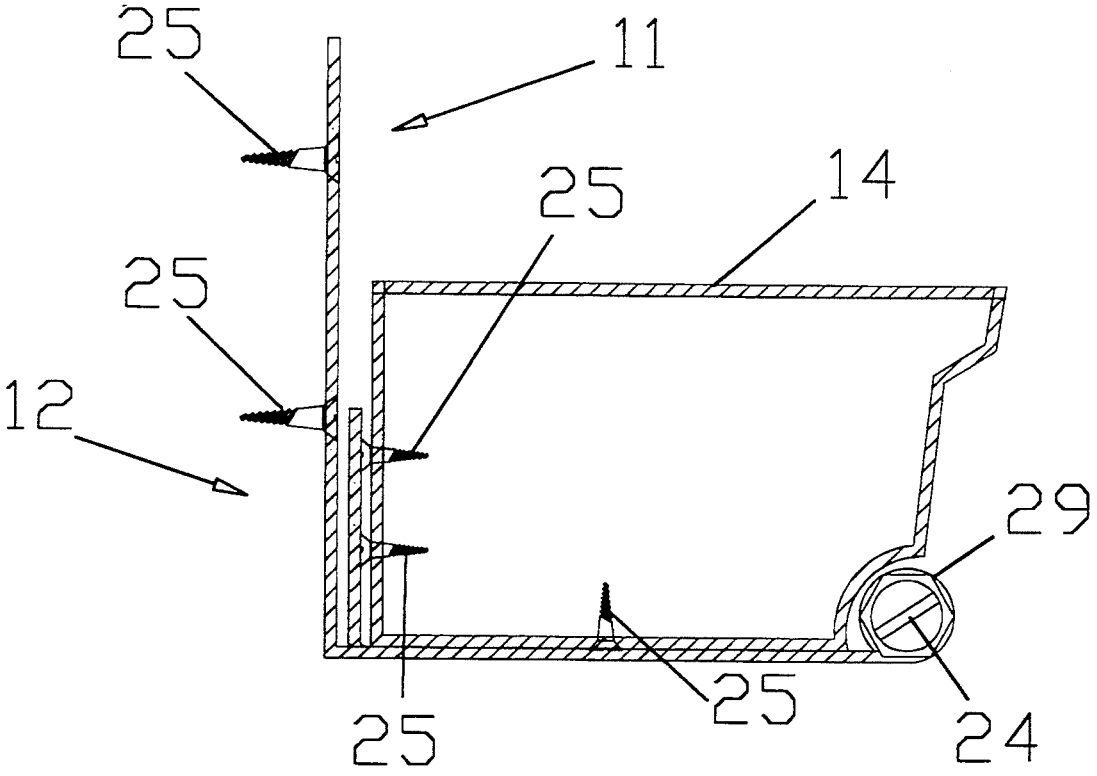
FIG. 7 is a sectional, side view of a standard gutter installed on a hinged hanger.
Figure 8:
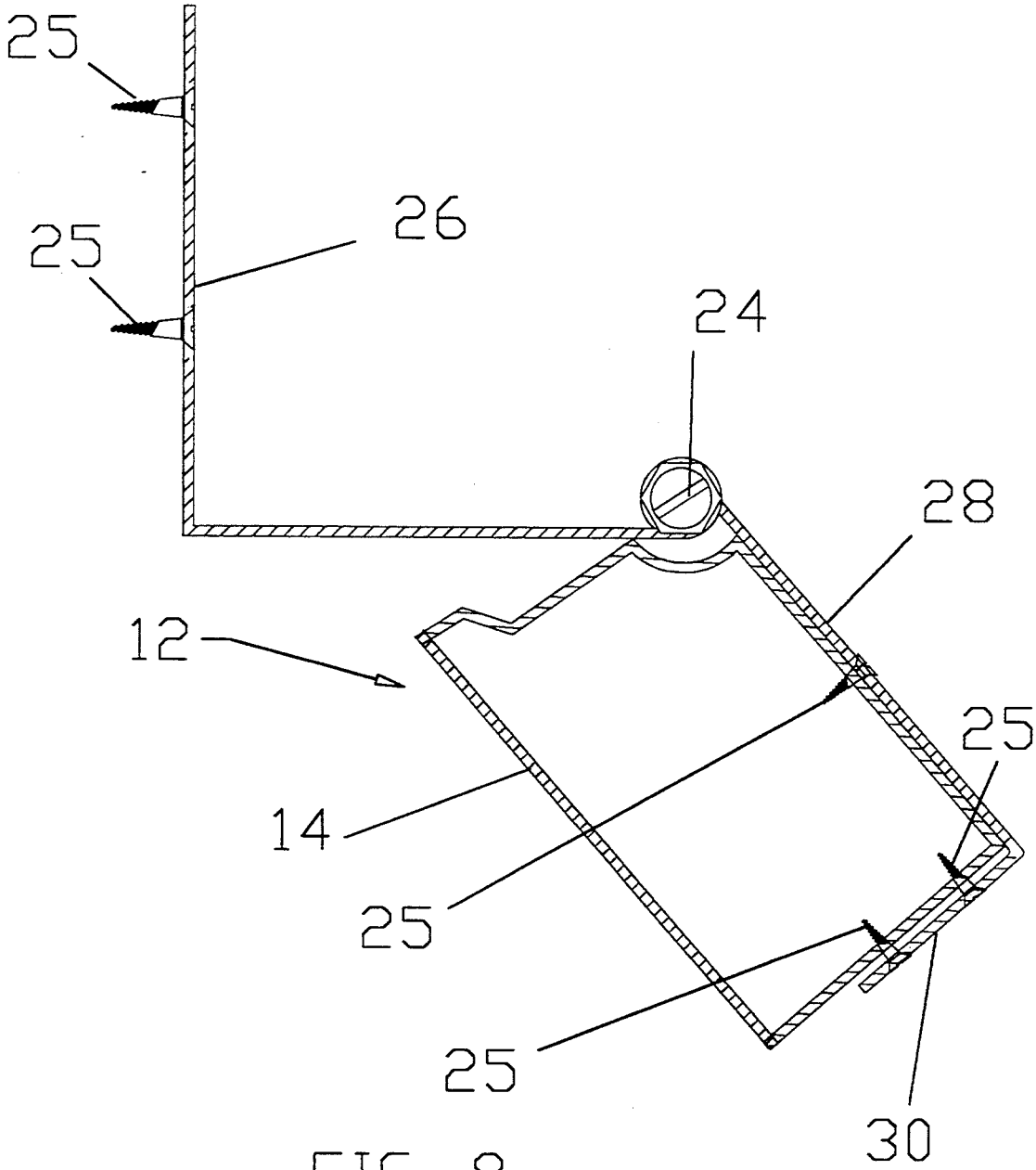
FIG. 8 is a sectional, side view of a standard gutter installed on a hinged hanger in a full tilt position.

FIG. 4 shows a top view of hinged hanger 10 as if it were in place on a building and FIG. 3 is a front view of the hinged hanger 10. Hinged section 12 may be stamped out of the metal plate used to fabricate support bracket 11 as shown in FIG. 6. Vertical panel 30 of hinge section 12 contains holes 23 for screws 25 for fastening to the gutter 14. Hinge loops 29 of hinged section 12 and support bracket 11 may be formed by bending the ends of horizontal support 31, and horizontal panel 28 to form a closed loop at each of the ends. The hinged hanger 10 is assembled by aligning the hinge loops 29 in end to end relationship and inserting hinge pin 24 through the aligned hinge loops 29. In a preferred embodiment, hinge pin 24 was standard ⅜ inch bolt and lock nut. The support bracket 11 and hinge section 12 may also be molded out of plastic. The entire assembly of the hinged hanger 10, and including the gutter 14, may be conveniently lifted and fastened to the fascia 14. After mounting the pulley 15 and attaching the line 16, the hinged hanger is in operating position.

While particular examples of the present invention have been shown and described, it is apparent that changes and modifications may be made therein without departing from the invention in its broadest aspects. The intent of the appended claims, therefore, is to cover all such changes and modifications as fall within the true spirit and scope of the invention.

What is claimed is:

1. A hinged hanger system for pivotably attaching a rain gutter to the fascia of a building beneath the edge of a roof comprising:

a plurality of hinged hanger rain gutter supports for mounting and supporting a rain gutter on a building, said supports having an "L-shaped" support bracket and an "L-shaped" hinge section, said support bracket having a vertical panel with holes for mounting screws, two horizontal supports extending horizontally from said vertical panel, spaced apart, and parallel to each other and having hinge loops formed on said horizontal supports, said support bracket being affixed to said building with said mounting screws, and being sufficiently long to hold and support said rain gutter, said hinge section having a vertical panel with holes for mounting fasteners, a horizontal support panel extending from said vertical panel, and having at least one hole for a mounting fastener, and a hinge loop formed on said horizontal panel, said hinge section being attached to said rain gutter with said mounting fasteners, and being sufficiently long to hold and support said rain gutter, said hinge section being nested between said horizontal supports with said hinge loops in alignment with each other and, pinned together with a hinge pin, and a pulley means attached to said fascia, said pulley means having a first length of line threaded therethrough and attached to said rain gutter at a first position, and a second length of line threaded therethrough and attached to said rain gutter at a second position, whereby pulling on said first line results in tilting said gutter to a dumping position and pulling on said second line results in resetting said gutter to a receiving position.

* * * * *